United States Patent [19]

Chodil et al.

[11] 3,992,644

[45] Nov. 16, 1976

[54] CATHODOLUMINESCENT DISPLAY WITH HOLLOW CATHODES

[75] Inventors: Gerald J. Chodil, Highland Park; Michael C. DeJule, Chicago, both of Ill.; David Glaser, Greenbrook, N.J.

[73] Assignee: Zenith Radio Corporation, Chicago, Ill.

[22] Filed: June 20, 1975

[21] Appl. No.: 588,737

[52] U.S. Cl. ..... 313/217; 313/209; 313/491

[51] Int. Cl.[2] ..... H01J 61/06

[58] Field of Search ..... 313/209, 217, 188, 220, 313/491

[56] References Cited

UNITED STATES PATENTS

| | | | |
|---|---|---|---|
| 3,622,829 | 11/1971 | Watanabe | 313/108 R |
| 3,701,918 | 10/1972 | Allen et al. | 313/209 |
| 3,801,864 | 4/1974 | Yamane et al. | 313/108 B |
| 3,831,052 | 8/1974 | Knechtli | 313/209 X |
| 3,845,241 | 10/1974 | Schwartz | 313/108 B |
| 3,882,342 | 5/1975 | Kamegaya et al. | 313/209 X |

OTHER PUBLICATIONS

Bayless, et al., "IEEE Journal of Quantum Electronics" Feb. 1974, pp. 213–218.

"Plasma Cathode for E-Beam Lasers," Hughes Research Labs., Nov. 1972, Distributed by National Technical Information Service, U.S. Dept. of Commerce.

*Primary Examiner*—R. V. Rolinec
*Assistant Examiner*—Darwin R. Hostetter

[57] ABSTRACT

A novel structural combination for use in gas discharge panels for generating alpha-numeric and video images which exhibit a high level of brightness, even in panels scanned in a point-at-a-time mode and at television scan rates. The combination includes row-wise extending hollow cathodes comprising upper and lower metal cathode plates between which a hollow cathode discharge is generated. The spacing between cathode plates is selected to insure that an efficient hollow cathode discharge is created. Situated forward of the hollow cathodes are a first electrontransmissive grid means for extracting electrons from the hollow cathode dischage, a second electron-transmissive grid means for controlling the flow of electrons through the first and second grid means, and a faceplate having a phosphor coating thereon and adapted to receive an energizing potential for accelerating toward the phosphor coating those electrons which pass through the second grid means. The faceplate and the second grid means are spaced apart by a distance which is too small to sustain a gas discharge at a gas pressure which exists in the panel.

25 Claims, 13 Drawing Figures

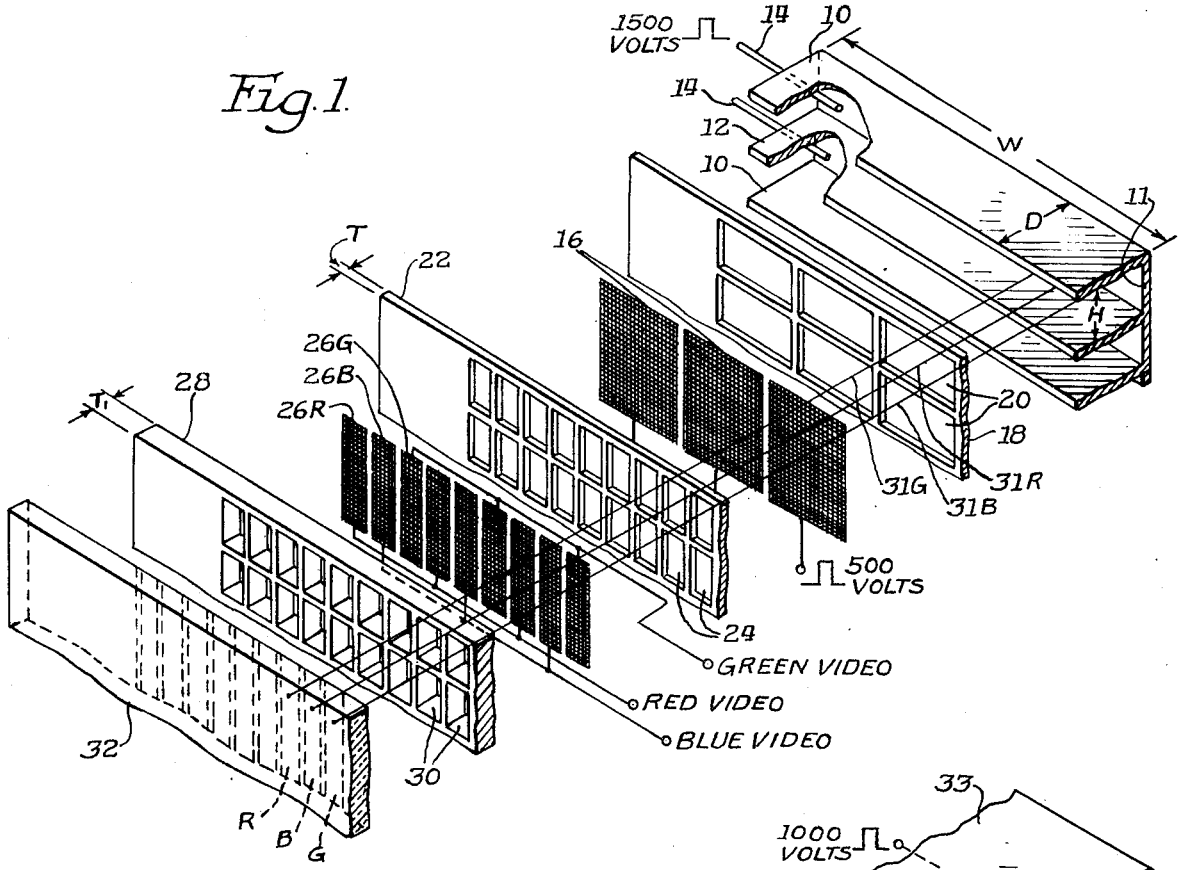
Fig. 1.
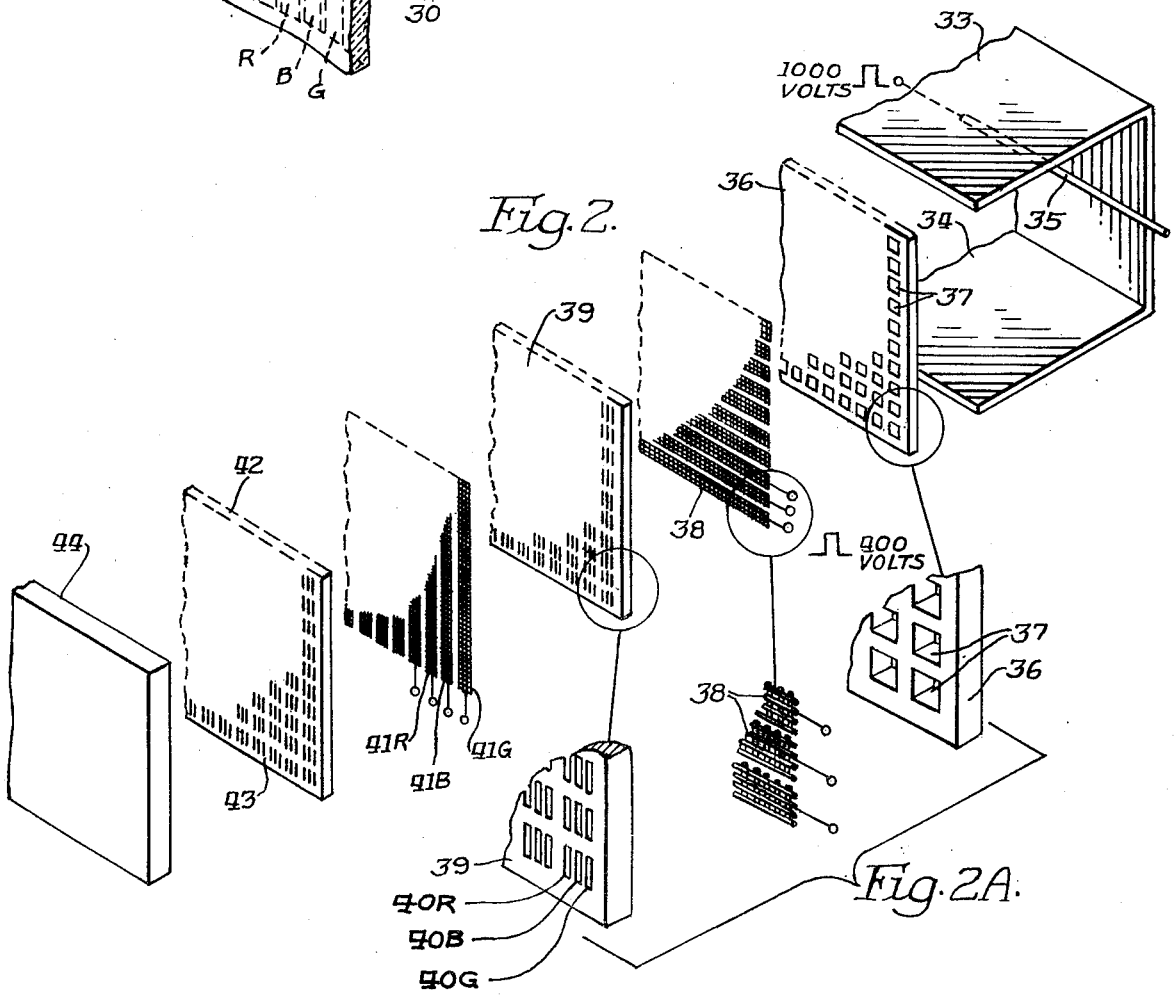
Fig. 2.
Fig. 2A.

Fig. 4.
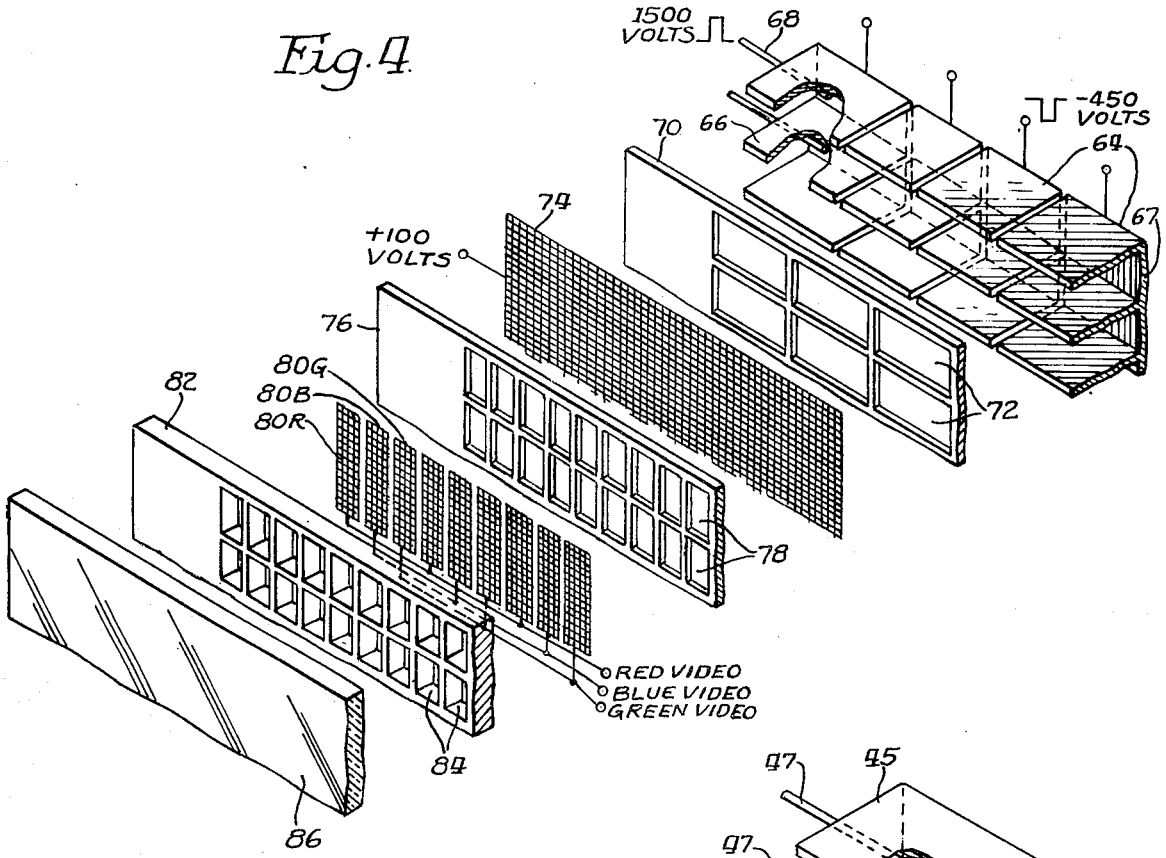
Fig. 3.
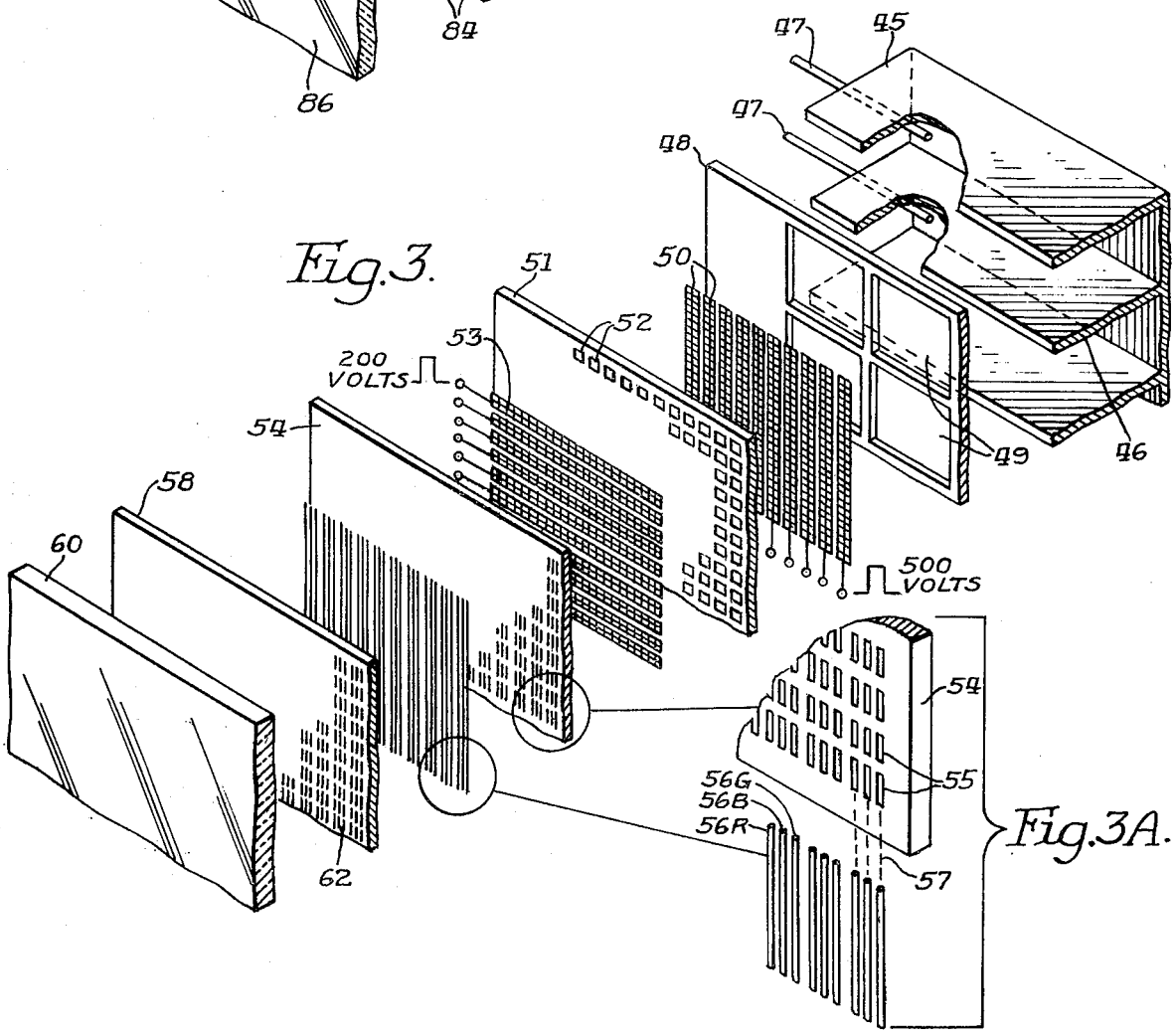
Fig. 3A.

Fig. 9.
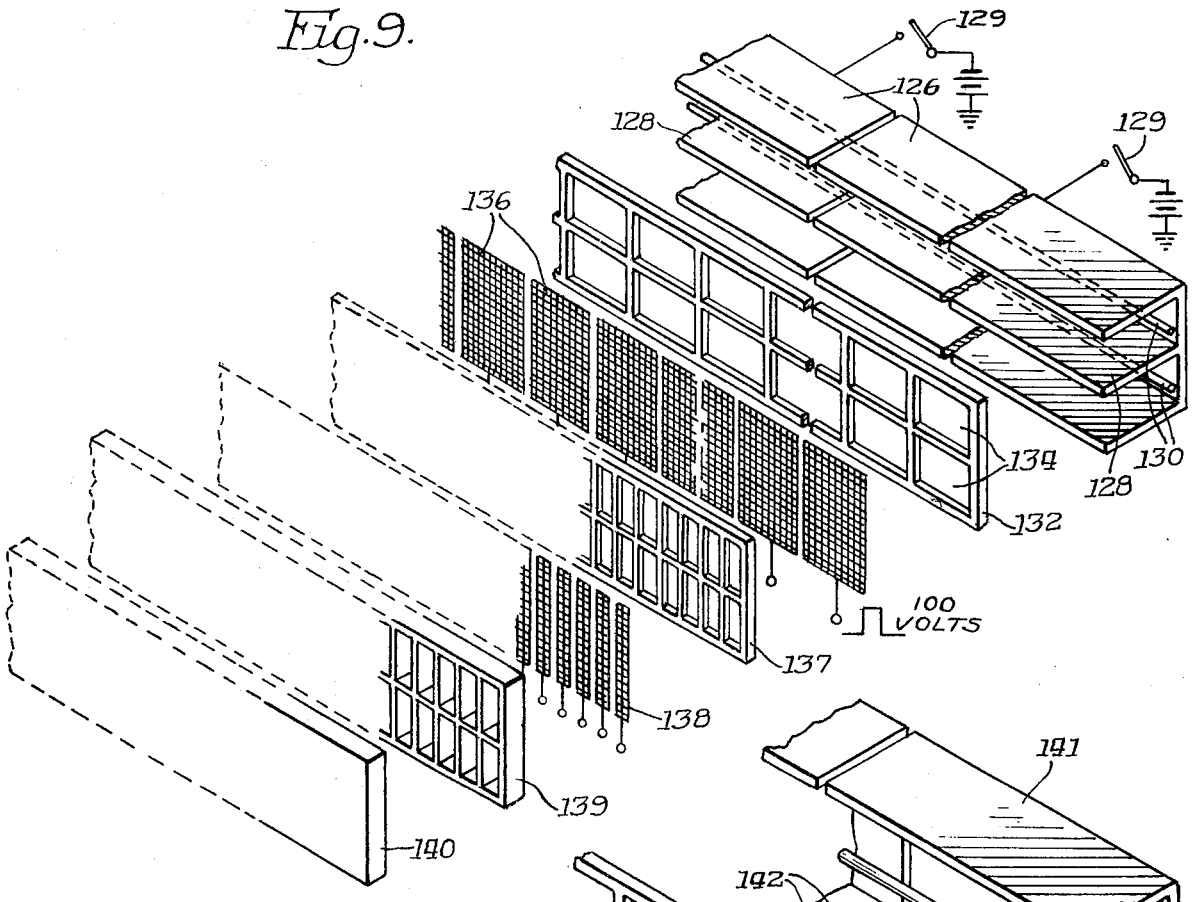
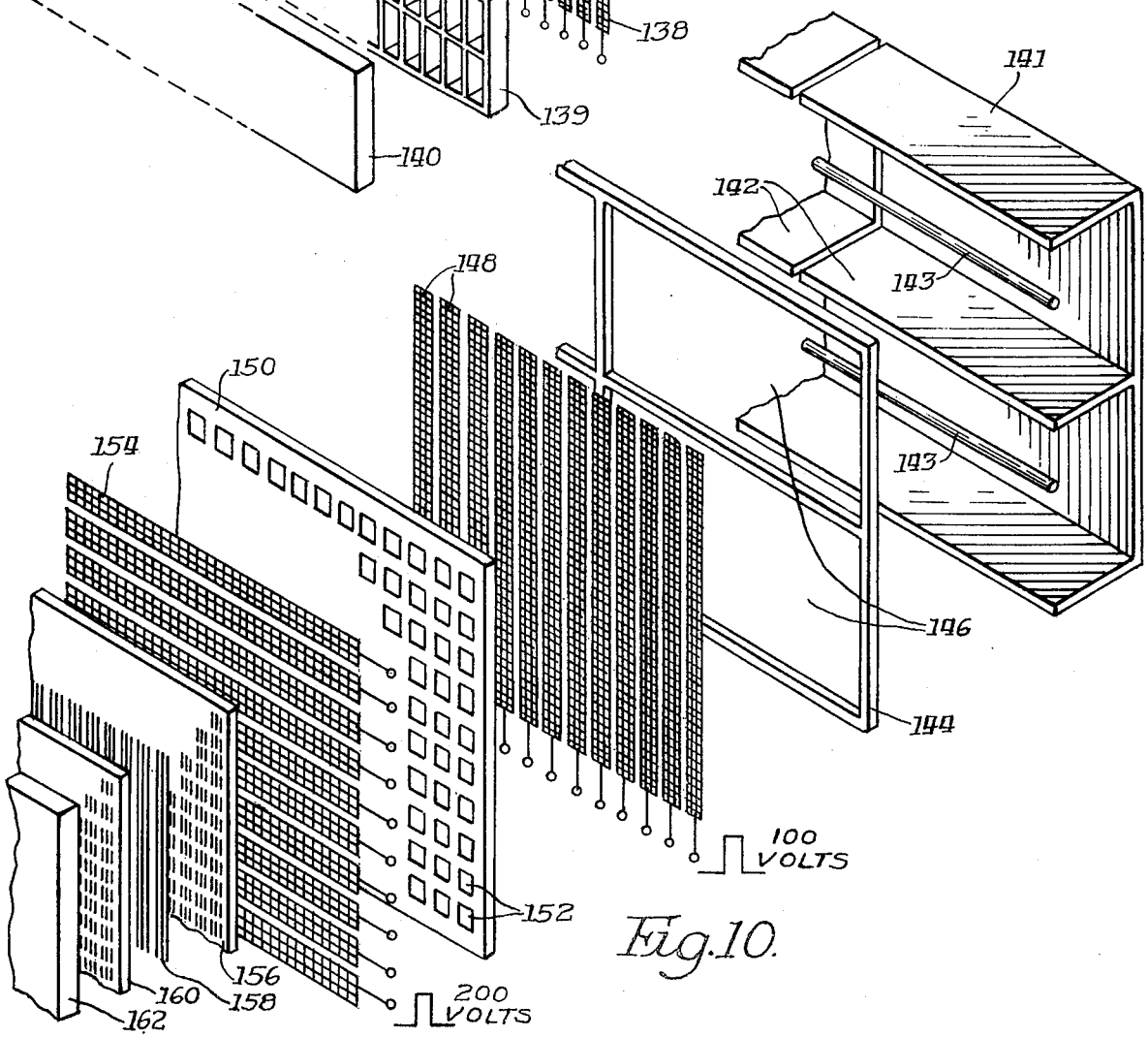
Fig. 10.

CATHODOLUMINESCENT DISPLAY WITH HOLLOW CATHODES

BACKGROUND OF THE INVENTION

This invention relates to gas discharge panels for use in displaying alpha-numeric information, advertising displays, television images and the like.

Most prior art gas discharge panels have been unable to complete successfully with cathode ray tubes in generating visual images. This has been true, for the most part, because of the inability of gas discharge panels to produce images which are as bright as the images generated by cathode ray tubes (CRT's). In addition, most gas discharge panels require complex driving circuitry since they usually drive one full row or line of characters or picture elements at a time (line-at-a-time operation) in order to generate a brighter display. This line-at-a-time operation requires circuitry for storing one complete row of information while simultaneously displaying another row of information. Cathode ray tubes, on the other hand, are usually driven point-at-a-time and do not therefore need the storage circuitry which the line-at-a-time gas discharge displays need.

This lack of brightness and resultant inability of most priorr art gas discharge displays to be operated in a point-at-a-time mode has made it difficult for such displays to complete effectively with cathode ray tubes, particularly in the area of reproducing television images.

Although some gas discharge panels have been used to reproduce television images, they have been operated in a line-at-a-time mode wherein all picture elements of a line or row of picture information are simultaneously energized for approximately 52 microseconds. But even operating in this line-at-a-time mode, most prior gas discharge panels are unable to generate images as bright as those possible with CRT's.

A gas discharge panel operated in a point-at-a-time mode has even less chance of generating a competitively bright image since it would energize only one picture element at a time, thereby reducing the "ON" time of each picture element by a factor of approximately 500. Of course, a corresponding reduction in the image brightness would follow and, for prior art gas discharge panels, would result in a reproduced image which would be far too dim for practical use.

OBJECTS OF THE INVENTION

It is an object of this invention to provide a gas discharge panel capable of generating images which are much brighter than the images of prior art gas discharge panels for use in line-at-a-time image reproduction.

It is another object of this invention to provide a gas discharge panel which is so much brighter than prior art panels that it may be scanned point-at-a-time rather than line-at-a-time, thereby greatly reducing the amount of driving circuitry required.

It is a further object of this invention to provide means for effecting efficient point-at-a-time image scanning in a gas discharge panel.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings in which:

FIG. 1 is an exploded and partly schematic view of a point-at-a-time gas discharge structure according to this invention;

FIG. 2 is an exploded and partly schematic view of a line-at-a-time gas discharge structure according to this invention;

FIG. 2A is an enlarged view of selected portions of the FIG. 2 structure;

FIG. 3 is an exploded and partly schematic view of another point-at-a-time gas discharge structure according to this invention;

FIG. 3A is an enlarged view of selected portions of the FIG. 3 structure;

FIG. 4 is an exploded and partly schematic view of another point-at-a-time gas discharge according to this invention;

FIG. 9 is an exploded and partly schematic view of a point-at-a-time gas discharge structure according to this invention; and FIG. 10 is an exploded and schematic view of another point-at-a-time gas discharge structure according to this invention.

DESCRIPTION OF THE PREFERRED EMBODIMENT

Figures 5, 5A:
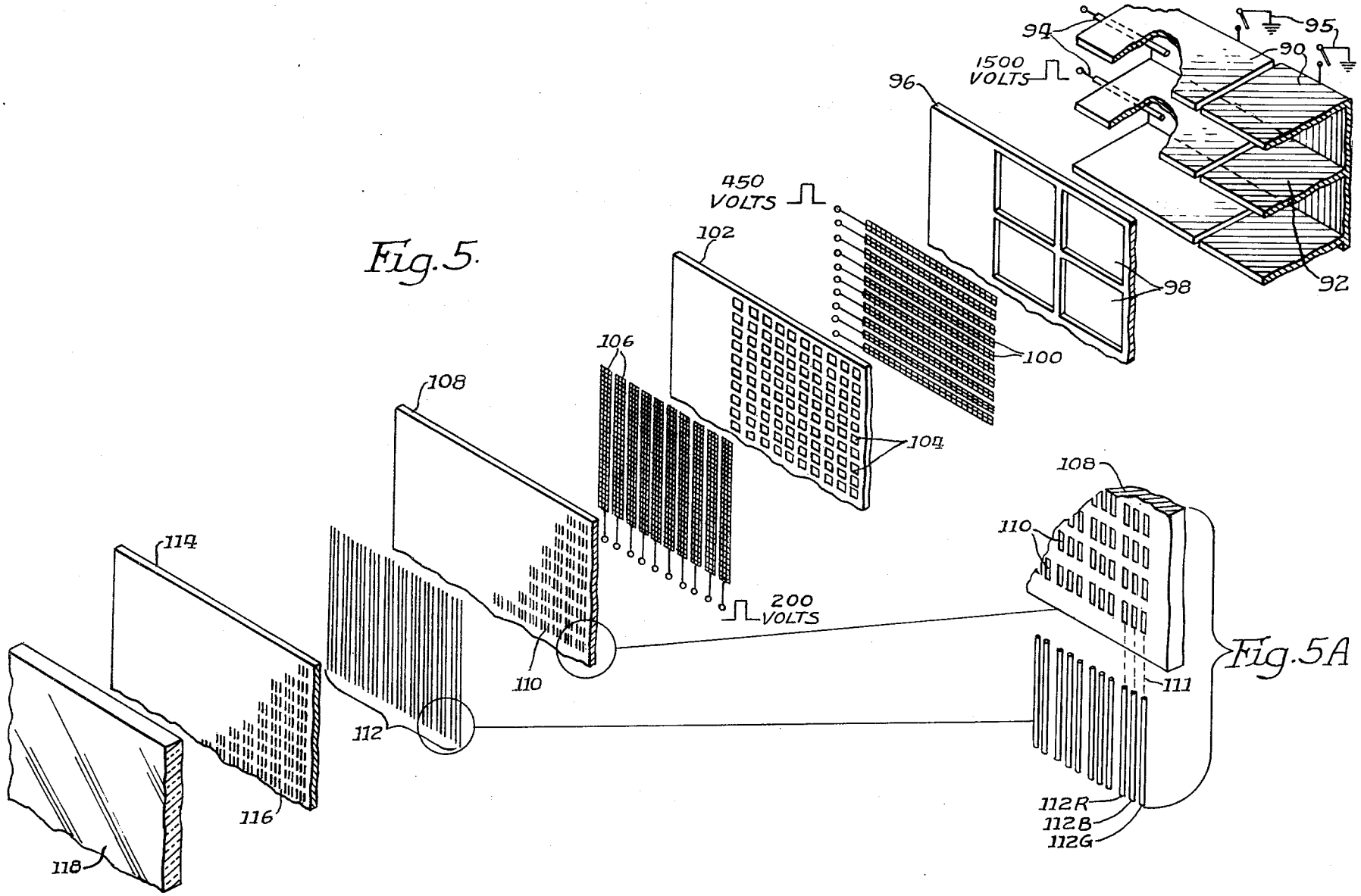
FIG. 5 is an exploded and partly schematic view of another point-at-a-time gas discharge structure according to this invention.
FIG. 5A is an enlarged view of selected portions of the FIG. 5 structure.

As has been pointed out above, this invention is directed toward a gas discharge display panel which is much brighter than prior art panels and particularly bright enough for use in displaying television images in a point-at-a-time mode of operation.

Some of the brightest and most efficient prior art gas discharge panels have been of the photoluminescent variety (ultraviolet excitation of a phosphor target), yet none of them appear to be able to generate the light required for a point-at-a-time operation. The efforts leading up to this invention have, therefore, been directed toward a highly efficient discharge panel of the cathodoluminescent type wherein a phosphor target is excited directly by electron bombardment.

Toward this end and according to one aspect of this invention, a rich source of electrons has been developed specifically for use in a cathodoluminescent gas discharge display panel. This electron source takes the form of a special hollow cathode, which, together with an anode or anodes, generate in efficient hollow cathode discharge which supplies electrons in sufficient quantity to supply a high current density electron stream forbombarding and exciting a light-emissive phosphor target.

The use of hollow cathodes for developing rich sources of electrons is known in the art. Other fields of endeavor have developed means for extracting from a hollow cathode discharge a stream of electrons and for accelerating that stream toward a designated target. An example of such a device is found in the field of laser pumps, one of which is described in U.S. Pat. No. 3,831,052.

Briefly, such prior art devices operate as follows. A hollow cathode discharge is usually excited within a volume enclosed by a hollow, cylindrical cathode shell and a first anode which is flush with an opening in the hollow cathode shell. The first anode is perforated to permot the passage of electrons through it and toward an accelerating anode. A second perforated anode, spaced between the accelerating anode and the first anode, acts as a control grid to control the flow of electrons through the perforations in the first and second anodes.

Because of the fact that the hollow cathode is very efficient, the entire device can be operated at a very low pressure. With such a low pressure, the second anode can be spaced from the accelerating anode by a distance which is too small to sustain a discharge between the accelerating anode and the second anode. This corresponds to operation on the left slope of the Paschen curve. With a high voltage applied to the accelerating anode and a control voltage applied to the second anode, a stream of electrons from the hollow cathode to the accelerating anode can be conveniently controlled without creating a discharge in the space between the control anode and the target. According to one aspect of this invention, it has been discovered that some of the principles applicable to such laser pump devices may be made useful in the field of gas discharge displays which are operated in a line-at-a-time mode in a way which provides much more brightness than has been previously available from other gas discharge displays. According to another aspect of this invention, such improved gas discharge devices are scanned at a rate corresponding to television scan rates so as to excite individual picture elements in a point-at-a-time mode operation so as to generate, even in the point-at-a-time mode of operation, a television image having a brightness comparable to that of commerical cathode ray tubes.

Several embodiments of this invention are illustrated herein and will be described in the discussion to follow. Although each embodiment has its own advantage, all are useful with gas discharge display panels and will generate images which are much brighter than images made by prior art panels.

Some embodiments include means for causing the hollow cathode discharge to scan in a point-at-a-time mode, although those same embodiments can also be adapted to line-at-a-time operation. All embodiments are shown with the necessary electrodes for producing color images, although each is also adaptable for use in producing monochrome images, particularly for use with alpha-numeric groplin displays.

Referring now to FIG. 1, a schematic view is shown of one embodiment of this invention. This particular embodiment is designated to operate in a helium atmosphere at a pressure of approximately 4 Torr. (This and other embodiments of the invention are also operable with other ionizable gases). The FIG. 1 view depicts the electrodes which are required to generate two rows or lines and three columns of a video display in a flat panel gas discharge display system. It will be understood that, unless stated otherwise, the structures shown in the Figures can be repeated to include as many rows and columns as are necessary for a particular application.

For television applications, approximately 480 rows and 480 columns for each color are required.

The electrode structures of FIG. 1 will now be described in the order in which they are arranged in a panel. Starting from the rear of the panel, a hollow cathode means is shown which includes a pair of upper and lower metal cathode plates, 10 and 12. A rear plate 11 connects plates 10 and 12 and helps provide an efficient hollow cathode. However, plate 11 is discretionary and mmay be omitted if the hollow cathode is efficient enough forthe particular application. The plates 10 and 12 extend row-wise across the panel and substantially parallel to each other. The volume which is partially enclosed by the plates 10 and 12 is the location where a hollow cathode discharge is created for generating a rich source of electrons.

Plates 10 and 12 are electrically coupled and are preferably at ground potential. Good results have been obtained with plates made of a metal designated as Carpenter 42-6, available from Carpenter Technology, Inc., of Reading, Pennsylvania. The same metal can be used to fabricate all the electrodes shown in the accompanying Figures. The general characteristics of a metal which is usable include an expansion coefficient which is nearly the same as that of glass (assuming that the panel enclosure is made of glass), an ability to be hermetically sealable with glass, a low work function, and a resistance to sputtering.

The structural aspects of the hollow cathode which are important include the depth of plates 10 and 12 (distance D in FIG. 1), the distance between plates (distance H in FIG. 1) and the width of the plates (distance W in FIG. 1). Generally, the spacing H between the upper and lower plates 10, 12, is selected to be between 0.1 and 3.0 times the length of the cathode fall of a planar (as opposed to hollow) cathode made of the same metal as plates 10 and 12 are operating in an atmosphere of the same gas and at the same pressures at which plates 10 and 12 are operated. Such a spacing will ensure that an efficient hollow cathode discharge can be created between plates 10 and 12 which will provide the rich source of electrons needed to generate a very bright image.

The hollow cathode discharge which is generated between plates 10 and 12 is also affected by the depth D of the plates. Generally, plates 10 and 12 should be at least as deep as the spacing H between plates. For this particular embodiment, an H of 43 mils and a depth of 60 mils were found to be acceptable.

For the FIG. 1 embodiment, the spacing between plates 10 and 12 is approximately equal to the height of a picture element in a 35 inch diagonal display. (A picture element is defined herein as the smallest discrete, excited light-emitting unit on a panel faceplate.) In a system which is not bandwidth limited and which has triads consisting of red, blue and green phosphor deposits on a viewable faceplate, a picture element is one triad wide and has a height equal to the height of the viewable faceplate area divided by the number of scanned rows. For television applications there are approximately 480 scanned rows. Thus, for a 35 inch diagonal viewing area, a panel generating television images by exciting phosphor triads 60 mils wide has picture elements which are approximately 43 × 60 mils large.) Therefore, for each row of picture elements, there is one row of hollow cathodes defined by plates 10 and 12. In other embodiments which will be discussed below, the separation between cathode plates will be greater than the height of a picture element so that one row of hollow cathodes can supply electrons for multiple rows of picture elements.

Although the width W of plates 10 and 12 in FIG. 1 is shown as being as wide as a complete row of picture elements, such will not be the case in every embodiment of this invention. Accordingly, a general statement of the required width is that the width should be at least as great as the distance H between plates. The greater the width of plates 10 and 12, the greater is the efficiency of the hollow cathode discharge between the plates. However, a plate width which is equal to the spacing between plates has been found to be acceptable. An embodiment of this invention having such narrow plates will be described below.

An ignitor wire 14 of approximately 1 mil diameter protrudes into each row of hollow cathodes to initiate a hollow cathode discharge therein. The ignitor wires successively receive a 1500 volt ignitor pulse for approximately 10 microseconds at the beginning of each line of a display. As the ignitor pulse is stepped from one ignitor wire to the next, the hollow cathode discharge moves from row to row down the panel, thus providing row-wise scanning of the display. Although this (FIG. 1) and other embodiments of this invention are shown as having ignitor wires for assisting in the row-by-row scanning of the panel, the use of such wires is intended to be merely exemplary. A panel may alternately be scanned row-by-row by including a priming chamber which runs from top to bottom along a side edge of the panel and which communicates with each row of the panel through priming apertures. The gas in the priming chamber is ignited by an ignitor wire located near the top of the chamber, thereby forming a "priming discharge". By having electrodes protruding into the priming chamber at each row located and by stepping an appropriate priming pulse from one such electrode to the next, the priming discharge is caused to propagate down the priming chamber in a row-by-row manner and to permit a "primed" row to discharge.

Situated forward of the parallel plate hollow cathode is a first electron transmissive grid means consisting of an array of column-wise extending scan grids 16. Each grid 16 may take the form of a wire mesh or perforated metal sheet or other form as long as it is electron-transmissive and can receive a potential for creating an electric field between itself and the hollow cathode for extracting electrons from the hollow cathode discharge. The electrons which are extracted from the discharge pass through the perforations in grids 16 and are accelerated toward a phosphor target in a manner to be described.

As shown in FIG. 1, scan grids 16 are adapted to sequentially receive a 500 volt pulse whose duration is approximately 125 nanoseconds. This pulse is stepped from one scan grid 16 to the next adjacent scan grid in order to cause the display to be stepped column-by-column along the entire width of the panel. A duration of 125 nanoseconds was chosen for the scan pulse so that a flat panel constructed according to FIG. 1 could generate a television image in accordance with commerical television point-by-point scan rates.

In the case where the FIG. 1 embodiment is used to generate color images from a television signal, each scan grid 16 is approximately 1 triad wide, where a triad is defined as one group of adjacent red, green and blue phosphor deposits on the panel faceplate.

Between cathode plates 10 and 12 and scan grids 16 is spacer 18. Spacer 18 includes an array of apertures 20 through which the extracted electrons pass. Note that spacer 18 has no apertures where it covers ignitor wires 14 since the portions of the hollow cathodes into which ignitor wires 14 protrude are used only for initiating now discharges.

Spacer 18 is made of a dielectric material such as ceramic and is about 5 mils thick. The hollow cathode discharge extends from between plates 10 and 12 through apertures 20 and up to an energized scan grid 16. In another embodiment of this invention, spacer 18 is approximately one inch thick so that scan grids 16 are separated from cathode plates 10 and 12 by a much greater distance. The advantage obtained in the greater spacing between scan grid 16 and cathode plates 10 and 12 is not an aspect of this invention but will be explained in the discussion below for the sake of completeness. Although spacer 18 has been shown in FIG. 1 as having rectangular apertures 20, no such limitation is intended for spacer 18 or any of the spacers to be discussed below. Since the spacer apertures need not define the geometry of the electron beam but do serve to separate electrodes and to impart structural strength to the panel, the spacer apertures may be in the form of slots, ovals, etc., as long as they are large enough not to impede the electron beam.

At this point, it should be noted that the thickness of spacers and electrodes in the various Figures are not necessarily drawn to scale in order to conserve space. However, where the thickness of a particular element is not apparent or is important, it is expressly disclosed in the written portion of this specification.

The element immediately forward of scan grids 16 is another ceramic spacer 22 having an array of apertures 24. Each aperture 24 is approximately ⅓ the width of an aperture 20 and is designed to pass electrons for impingement only upon a phosphor of one designated color. That is, for each phosphor triad on the panel faceplate there is one triad of apertures 24 in spacer 22.

The thickness T of spacer 22 is preferably chosen to be too small to permit a gas discharge to exist forward of grids 16. Stated another way, the operating point of the gas which occupies the locations within apertures 24 is to the left of the standard Paschen curve for helium. However, T may be increased to the point where a discharge is permitted to extend forward of grids 16 without departing from the invention, although that mode of operation is deemed to be somewhat inferior.

Following spacer 22 is a second electron-transmissive grid means which includes an array of perforated modulation grids 26R, 26G and 26B. These grids receive the red, green and blue video signals for controlling the flow of electrons through scan grids 16 and through themselves for modulating the brightness of red, blue and green phosphors. Grids 26R receive a red video signal, grids 26G receive a green video signal and grids 26B receive a blue video signal, each grid having a width approximately equal to the width of its corresponding phosphor target.

As shown in FIG. 1, all grids 26R are electrically connected together as are grids 26B and 26G so that the video modulation is applied to the entire panel at once with the row and column selection being achieved by the action of ignitor wires 14 and scan grids 16, respectively.

The next element of the array is another dielectric spacer 28 which has an array of apertures 30 which corresponds to the array of apertures 24 in spacer 22. Spacer 28 has a thickness $T_1$ which, for the particular gas pressure used in a given panel, is too small to permit a gas discharge to exist between grids 26 and the phosphor coated faceplate 32 which receives a high accelerating voltage. In this case, spacer 28 has a thickness of 24 mils or less. As a result, the gas discharges preferably exist only between grids 16 and cathode plates 10, 12 while streams of electrons pass through grids 16 and 26 to strike phosphor targets.

The final element of the panel is the panel faceplate 32 which is situated flush with spacer 28. On the side of faceplate 32 facing spacer 28 are disposed red (R), blue (B) and green (G) phosphor targets (that is, phosphors which emit red, blue and green light when excited by electrons). These phosphor targets may be in the form of stripes or dots with black, light-absorbing material in between them and with each green phosphor target aligned with a grid 26G, each red phosphor target aligned with a grid 26R, etc.

An accelerating voltage of from 2000 to 10,000 volts is applied to faceplate 32 by coating its inner surface with a layer of tin oxide, a substantially transparent electrical conductor. The phosphors may then be deposited on the tin oxide and the accelerating voltage coupled to the tin oxide layer. Panel faceplate 32 is transparent and passes the light generated by the electron bombardment of the phosphor deposits through faceplate 32 to a viewer.

The operation of the FIG. 1 combination may be summarized as follows. In an atmosphere of helium at a pressure of 4 Torr, a hollow cathode discharge is generated in a row by the action of an ignitor electrode 14 acting as an anode in combination with cathode plates 10 and 12. When a scan grid 16 is energized it acts as an anode and the discharge spreads to the energized scan grid 16 which then extracts electrons from the discharge and permits the extracted electrons to pass through its openings. The number of electrons which pass through scan grids 16 is primarily determined by the amplitude of the video modulating signals which are applied to grids 26. The modulation of grids 26 by red, blue and green video signals and the effect of the accelerating voltage on faceplate 32 cause the electrons to pass through the apertures in grids 26 and spacer 28 and impinge upon the phosphor targets on faceplate 32, thereby generating a visible image. The trajectories of three sample electron beams are shown in FIG. 1 as lines 31R, 31B and 31G in order to more clearly point out the relative alignment of the various electrodes and spacers. This same alignment is found in other embodiments of this invention yet to be described.

The hollow cathode discharge is stepped row-by-row by the application of ignitor pulses to successive ignitor wires 14 (or by stepping a priming pulse fron row to row as described above). The hollow cathode discharge is stepped column-by-column across the panel by the application of scanning pulses to successive scan grids 16.

Although the FIG. 1 embodiment of this invention is for point-at-a-time image reproduction, it is adaptable to line-at-a-time operation. For example, replacing scan grids 16 with a unitary sheet grid extending all across the panel and receiving a DC voltage of 500 volts will convert the point-at-a-time structure of FIG. 1 to a line-at-a-time device. Obviously, all red, green, and blue grids 26 should receive separate video signals in the line-at-a-time mode.

Another method of converting the FIG. 1 embodiment to line-at-a-time operation includes replacing grids 16 with rows of grids extending the width of the panel. Each such row-wise extending grid is one picture element row high and is scanned line-at-a-time. Such grids which are not energized by a scan potential may be biased negative with respect to the cathode to insure that unwanted electrons are prevented from drifting past the non-scanning grids. Such biasing has the effect of increasing the contrast ratio.

The embodiments of the invention described above in connection with FIG. 1 include a cathode structure comprising cathode plates 10 and 12 and a back plate 11. Plate 11 serves, inter alia, to electrically connect each row of hollow cathodes. The above-described embodiments may be modified for further enhancing the contrast ratio of the display by replacing the unitary back plate 11 by separate back plates for each row of hollow cathodes, thereby electrically isolating each row of hollow cathodes from every other row of hollow cathodes. With this modification, an appropriate potential (300 volts, for example) is stepped from one row of hollow cathodes to the next adjacent row as scanning proceeds from the top to the bottom of the panel. In this way unwanted electrons from "off" rows will be prevented from drifting toward the faceplate and exciting phosphors which should be off.

Turning now to FIG. 2, there is shown an exploded view of a structure designed exclusively for use as a line-at-a-time gas discharge display in accordance with this invention. Beginning at the rear of the panel there is a cathode structure which includes upper and lower cathode plates 33 and 34. Plates 33 and 34 are substantially parallel to each other, extend forward towards the front to the panel, extend row-wise completely across the panel and are spaced apart by a distance equivalent to 10 rows of picture elements. In the case where the FIG. 2 structure is used in a 35 inch television display, the spacing between plates 33 and 34 is approximately 430 mils. The depth D of plates 33 and 34 is also approximately 430 mils.

An advantage of increasing the size of the hollow cathodes by increasing the spacing between plates 33 and 34 is that an efficient hollow cathode discharge can be created betwen the plates at a lower gas pressure. The use of a lower gas pressure in the panel permits the spacing between grids to be increased without allowing a discharge to exist between grids or between a grid and the phosphor screen. The greater spacing between grids also permits the use of a higher accelerating voltage on the faceplate and, consequently, a brighter and more efficient display.

An ignitor wire 35 extends into the volume which is partially enclosed by plates 33 and 34 and may extend across the entire width of the panel. A potential of approximately 1000 volts is applied to ignitor wire 35 for initiating a discharge between itself and the cathode structure.

Although only one set of cathode plates is shown, it is understood that the structure including plates 33 and 34 is duplicated for as many cathode rows as are necessary to complete the embodiment and an ignitor wire 35 is situated in each row of hollow cathodes.

Immediately forward of the plates 33 and 34 is a dielectric spacer 36 which is approximately 10 mils thick. Spacer 36 has an array of rectangular apertures 37 which have a width of approximately equal to the width of one triad. In the case shown, there are 10 rows of apertures 37 communicating with the volumn partially enclosed by plates 33 and 34. Apertures 37 are shown in greater detail in FIG. 2A.

Following spacer 36 is an array of electron-transmissive grids 38, each of which extends row-wise across the panel. Grids 38 successively receive a scanning potential of approximately 400 volts for causing the panel to scan row-wise from top to bottom. For each row of apertures 37 in spacer 36, there is one grid 38. See FIG. 2A. Preferably, approximately each 10th grid 38 is electrically connected and receives the same scanning potential. This means that a 10-phase driver is needed for scanning the panel from the top to bottom. (A 10-phase driver is an electrical circuit capable of applying scanning potentials to successive grids. Every 10th grid is electrically connected to one phase of the driver; for example, the first, eleventh, twenty-first, etc., grids are tied together and tied to phase one of the driver. The other grids are similarly connected to their respective phases of the driver.) For television applications, the scan potential is applied to each grid 38 for approximately 63 microseconds.

Following grids 38 is another spacer 39 having an array of apertures, 40R, 40B, 40G. See FIG. 2A. Spacer 39 is approximately 50 mils thick for the particular embodiment shown but the thickness of spacer 39 may vary but it must not be so thick as to permit a gas discharge to exist forward of grids 38 at the particular pressure used in the panel.

Apertures 40R, 40B and 40G are shown as rectangular and each have a width which is approximately equal to the width of one phosphor deposit on the faceplate. Aperture 40R is associated with a red-light-emission phosphor deposit, 40B with a blue-light-emissive deposit, etc. This means that there will be a triad of apertures 40R, 40B, 40G in alignment with each aperture 37 in spacer 36. This relationship is shown more clearly in FIG. 2A.

Following spacer 39 is an array of modulation grids 41R, 41B and 41G (shown disproportionately enlarged) one for each discrete aperture 40R, 40B and 40G, which receive the video signals for modulating the streams of electrons. Grids 41R received the red video signal, grids 41G receive the green video signal and grids 41B receive the blue video signal. Since in line-at-a-time operation each picture element in a row of picture elements will be illuminated simultaneously, the various red grids 41R may not be tied together, but must receive independent video signals for simultaneously energizing each picture element. The same is true for grids 41B and 41G. For this particular embodiment, video signals having an amplitude of approximately 200 volts peak to peak between grids 38 and 41 were found to be adequate.

Following grids 41R, 41B, 41G is another dielectric spacer 42 having an array of apertures 43. Apertures 43 are identical to and aligned with apertures 40R, 40B, 40G in spacer 39. The thickness of spacer 42 is approximately equal to the thickness of spacer 39. Thus, no gas discharge can exist in the area forward of grids 41R, 41B, 41G.

The final element of this structure is the glass faceplate 44 on which are deposited on its inside surfaces stripes of red, blue and green phosphors (not shown) which are aligned with apertures 43 and grids 41R, 41B, 41G. The phosphor deposits on faceplates 44 may alternately be rectangular deposits of phosphors, rather than stripes.

As with the FIG. 1 embodiment, a rich source of electrons is generated in a gas discharge which exists in the volume partially enclosed by cathode plates 33 and 34 and grids 38. The potential on a grid 38 extracts electrons from the gas discharge and passes them through its apertures to be modulated and accelerated forward to impinge on and excite a phosphor deposit on faceplate 44. Row selection is accomplished by successively energizing grids 38 and each picture element in arow is simultaneously energized by the various video signals applied to grids 41R, 41B, 41G. This particular embodiment has exhibited a contrast ratio in the range of 75 to 1 and a brightness of 400 foot-Lamberts of green light. This brightness compares favorably with a brightness of 8 foot-Lamberts for prior art line-at-a-time panels operated at televsion scan rates.

As shown in FIG. 2, ignitor wire 35 extends completely across the hollow cathode. Since plates 33 and 34 serve 10 rows of picture elements, ignitor wire 35 must be energized for an interval of approximately 633 microseconds, if television images are being generated. During that interval, ignitor wire 35 is effectively acting as the anode for the hollow cathode created by plates 33 and 34. If images having a height greater than 10 rows of picture elements are to be generated, there can be additional stacked rows of plates 33 and 34 with an ignitor wire between each pair of plates. As scanning proceeds from the top of the panel to the bottom of the panel, the ignitor wires 35 are successively energized for approximately 635 microseconds. As has been pointed out above, vertical scanning of a panel may also be effected by propagating a primary discharge down the panel at the proper scan rate. If that mode of vertical scanning is used, only a single ignitor wire 35 is needed for initiating a discharge in the top-most row of the panel. That ignitor wire then need extend only partially into the panel as shown in FIG. 1 and need be pulsed only once each frame. In that case, grids 38 act both as anodes for the energized hollow cathode and as extraction grids.

Referring now to FIG. 3, there is shown another embodiment of this invention wherein a hollow cathode discharge is established between cathode plates which are separated by a distance which is greater than one row of picture elements. In this embodiment, the elements are operated in a helium environment at a pressure of 0.8 Torr. As shown, the hollow cathode means includes a set of upper and lower metal cathode plates 45 and 46 which are separated by a distance equal, in this case, to five rows of picture elements. Thus, row selection cannot be accomplished by switching from row to row of hollow cathodes since each row of hollow cathodes serve five rows of picture elements.

Protruding into each row of hollow cathodes is an ignitor wire 47 which receives an energizing potential for exciting a hollow cathode discharge in the volume between hollow cathode plates 45 and 46.

Immediately forward of cathode plates 45 and 46 is a dielectric spacer 48 having an array of apertures 49. Each aperture 49 is five picture element rows high and has a width of five triads. Spacer 48 is approximately 50 mils thick.

Immediately following dielectric spacer 48 is an array of scan grids 50, each grid being one triad wide and adapted to receive a 500 volt energizing potential with a duration of 125 nanoseconds. The 500 volt energizing potential is stepped from one scan grid 50 to the next adjacent grid to cause the hollow cathode discharge to scan column-wise across the panel.

Following scan grids 50 is another dielectric spacer 51 having an array of apertures 52. Each aperture 52 is approximately one picture element high and one triad wide. Spacer 51 is approximately 50 mils thick.

A set of row-wise extending, electron-transmissive grids 53 is situated adjacent to and forward of spacer 51. Each grid 53 extends completely across the panel and is approximately one picture element high. Grids 53 receive another energizing potential of approximately 200 volts with respect to grids 50, which potential is stepped from one grid 53 to the next adjacent grid for scanning the panel row-wise from top to bottom, each grid 53 being energized for one line time. For television applications, each grid 53 is energized for approximately 53 microseconds.

Following grids 53 is another dielectric spacer 54 having an array of apertures 55. See FIG. 3A. Each aperture 55 in spacer 54 has a width of approximately ⅓ of a triad so that there are three apertures 55 for each grid 50. Dielectric spacer 54 is approximately 50 mils thick.

Following dielectric spacer 54 is another array of electron-transmissive modulation grids 56R, 56G and 56B. Each grid 56 is aligned with one aperture 55 in spacer 54 (see dashed lines 57 in FIG. 3A which point out the alignment between grids and apertures) and receives a red, blue or green video modulating signal for controlling the number of electrons which pass through grids 56 and strike a phosphor target.

In embodiments such as the one now being discussed and others to be described below which have three grid structures (50, 53 and 56 of FIG. 3), only the grid structure nearest the cathode and the grid structure nearest the faceplate must be mesh-like. Providing a mesh grid nearest the faceplate serves to shield the high voltage on the faceplate from the other electrodes and providing a mesh grid nearest the cathode serves to confine the discharge to the area between the cathode and its nearest grid. The middle electrode can then take another form such as a wire as long as it permits electrons to pass freely through or by it.

Dielectric spacer 58 follows grids 56 and separates them from faceplate 60. Spacer 58 has an array of apertures 62 identical to and aligned with apertures 55 in spacer 54. Spacer 58 is approximately 120 mils thick.

Faceplate 60 has deposited on its inner surface an array of phosphor triads (not shown) each triad including a red, blue and green phosphor deposit. Faceplate 60 is substantially identical to faceplate 32 of FIG. 1 and receives an accelerating potential in the same manner as faceplate 32.

The FIG. 3 embodiment of this invention operates, in principle, much like the FIG. 1 embodiment with the exception that an additional set of grids has been included since row selection cannot, in this embodiment, be accomplished by switching rows of hollow cathodes. As in FIG. 1, a hollow cathode discharge is excited between cathode plates 45 and 46 by the application of an ignitor pulse to an ignitor wire 47. With the application of an energizing potential to a scan grid 50 the hollow cathode discharge extends to the energized scan grid and some electrons within the discharge are extracted from the discharge and pass through the energized scan grid. With the application of an energizing potential to a gird 53 the electrons passing through the energized scan grid 50 are drawn through spacer 51 and grid 53. The video signals present on grids 56 then modulate the electron beam thus formed to vary the excitation of the phosphor targets on faceplates 60. The panel is scanned row-by-row by the application of an energizing potential to successive grids 53 and is scanned column-by-column by the application of an energizing potential to successive scan grids 50.

The FIG. 3 embodiment has been described in terms of a cathode structure having plates 45 and 46 separated by five rows of picture elements. The separation between plates 45 and 46 may vary depending on the particular application. For example, plates 45 and 46 may be separated by a distance equivalent to two rows of picture elements with odd numbers (and even numbered) grids 53 tied together. The odd and even numbered grids 53 are then alternately energized for periods of one television field (one sixtieth of a second) to provide field interlace. The remainder of the panel operates as described above.

In the discussion above relating to the embodiments shown in FIGS. 1 and 3, the panel was scanned column-wise by the application of an energizing potential to successive adjacent vertically-extending grids. This type of column-wise scanning will be referred to herein as anode scanning to contrast it with other embodiments in which discrete cathode segments are successively energized (cathode scanning) to effectuate column-wise scanning of a panel.

An advantage which cathode scanning provides is that the scanning is accomplished more efficiently than with anode scanning; that is, less power is dissipated in scanning by cathode scan than by anode scan. In other respects, however, the anode scan and cathode scan embodiments operate in a very similar manner.

FIG. 4 illustrates an embodiment of this invention which uses the cathode scan mode of column-wise scanning described above. Situated near the rear of a gas discharge panel is a hollow cathode means which includes rows of sequentially energizable hollow cathode segments. Each hollow cathode segment in a row of hollow cathodes has an upper plate 64 and an associated lower plate 66 constituting a pair of plates between which a hollow cathode discharge is established. Each pair of plates 64 and 66 is approximately one triad wide; that is, there is one pair of upper and lower cathode plates 64 and 66 for each column of the panel. Plates 64 and 66 are coupled by a back plate 67 to improve the efficiency of the hollow cathode.

A discharge is struck in a row of hollow cathodes by application of an ignitor pulse of approximately 1500 volts to ignitor wires 68 and by the application of another energizing potential, −450 volts, for example, to a pair of cathode plates 64 and 66. The hollow cathode discharge generated in the space between an upper and lower cathode plate is propagated across the panel column by column by stepping the energizing potential to successive adjacent hollow cathode plate pairs (segments).

The hollow cathode discharge existing in any row of hollow cathodes may be transferred to the next adjacent row by stepping the ignitor pulse to the next adjacent ignitor wire 68. Thus, row-wise and column-wise scanning of the panel can be effected by selectively energizing ignitor wires 68 and cathode plates 64 and 66 respectively. the row-wise scanning may, as explained above, also be effected by stepping a priming discharge from the top to the bottom of the panel.

In other respects, the embodiment shown in FIG. 4 operates in a manner similar to the embodiments discussed above with reference to FIGS. 1 and 3. As with the other embodiments, each electrode of the FIG. 4 embodiment is separated from an adjacent electrode by a dielectric spacer. The first dielectric spacer is spacer 70 which is immediately adjacent to the hollow cathode plates at the rear of the panel. Spacer 70 is approximately 5 mils thick and has an array of apertures 72, each of which is approximately 1 triad wide and one picture element high.

Adjacent to spacer 70 is an electron-transmissive grid 74 which extends over the entire height and width of the panel. Grid 74 receives a constant DC voltage of +100 volts for extracting electrons from the hollow cathode discharge.

Following grid 74 is another dielectric spacer 74 with an array of apertures 78. Each aperture 78 is approximately one picture element high and has a width of approximately the size of ⅓ of a triad. Spacer 76 has a thickness of approximately 5 mils.

Following spacer 76 is an array of electron-transmissive modulation grids 80 which receive video modulating signals for controlling the flow of electrons to the faceplate. Each grid 80R receives a red video signal and is electrically connected to each other grid 80R of the array. Grids 80G and 80B are similarly connected. Each grid 80 extends column-wise for the entire height of the panel and has a width of approximately ⅓ of a triad.

Dielectric spacer 82 is adjacent to grids 80 and has an array of apertures 84 which are identical to apertures 78 in spacer 76. The thickness of spacer 82 is approximately 24 mils.

A glass faceplate 86 rests on spacer 82 and has deposited on its inner surface triad stripes of phosphors (not shown), each phosphor triad consisting of a red phosphor deposit, a blue phosphor deposit and a green phosphor deposit. The phosphor stripes are, of course, in alignment with aperture 84 in spacer 82 and with grids 80. Specifically, each red phosphor deposit is in alignment with a grid 80R, with a similar alignment for the green and blue phosphor deposits.

As has been pointed out above, it is advantageous to increase the size of the hollow cathodes in order to permit the use of a lower gas pressure and a greater spacing between grids and between the grids and the faceplate. This advantage was discussed in connection with the embodiment shown in FIG. 2 wherein cathode plates 33 and 34 were separated by a distance of 10 picture element rows and extend row-wise across the panel. In another embodiment of this invention to be described, the separation between cathode plates and its attendant advantages are combined in a hollow cathode structure with vertical segmentation of the cathode structure to provide yet a more efficient operation.

Referrence is now made to FIG. 5 to more thoroughly explain the improved cathode structure for use in an efficient point-at-a-time mode of operation. The FIG. 5 embodiment does include an additional array of grids as compared to the FIG. 4 embodiment and thereby imposes somewhat additional complexity on the panel, but the increase in efficiency provided by the hollow cathode structure more than compensates for the increased complexity.

The hollow cathode structure of the FIG. 5 embodiment operates in an environment of 0.8 Torr of helium, for example, and includes pairs of upper and lower cathode plates 90 and 92. The plates 90, 92 are separated by a distance which is equivalent to 5 rows of picture elements. The width of each cathode plate is approximately equal to the width of 5 triads. Rather than extending each plate 90, 92 row-wise completely across the panel as was done in the FIG. 3 embodiment, the plates are segmented as shown so that each plate is only 5 triads wide. Since for point-at-a-time operation only a small fraction of an entire row is in use at any one time, extending a hollow cathode discharge completely across the panel is wasteful of energy. By breaking the hollow cathode discharge down into smaller segments having a width of 5 triads (a cathode "segment" being 1 upper plate 90 and an associated lower plate 92), the efficiency of the discharge is greatly increased. However, since a hollow cathode discharge will now be 5 picture element rows high and 5 triads wide, row and column selection cannot be achieved by the cathode scan techniques used in the FIG. 4 embodiment. Instead, separate grid structures are required to effectuate the row and column selection of the individual picture elements.

An ignitor wire 94 protrudes between plates 90 and 92 in each hollow cathode row and receives an ignitor pulse of approximately 1500 volts for initiating the hollow cathode discharge in each row of hollow cathodes. After an interval equal to 5 row times, the ignitor pulse is applied to the next adjacent ignitor wire 94 for stepping the discharge to the next row of hollow cathodes. Alternately, the discharge can be caused to propagate from row to row by stepping a priming discharge from the top to the bottom of the panel, all as previously described.

In order to move the discharge row-wise across the panel, adjacent pairs of cathode plates 90 and 92 are successively grounded (as indicated schematically by switches 95) after an interval equal to the scan time of 5 triads. At television scan rates, each pair of plates 90, 92 would be grounded for approximately 0.625 microseconds.

Adjacent to cathode plates 90, 92 is a first dielectric spacer 96 having a thickness of approximately 20 mils. Spacer 96 has an array of apertures 98, each of which is approximately 5 picture element rows high and 5 triads wide.

Adjacent to spacer 96 is an array of electron-transmissive grids 100 which extend row-wise completely across the panel. Each grid 100 is approximately 1 picture element high and receives a voltage of approximately 450 volts which is stepped from one grid 100 to the next adjacent grid in order to provide row-wise scanning of the panel.

Following grids 100 is a second dielectric spacer 102 which is approximately 20 mils thick. Spacer 102 has an array of apertures 104, each of which is approximately one picture element high and has a width of approximately one triad.

Adjacent to spacer 102 is another array of electron-transmissive grids 106, each of which extends column-wise for the height of the panel. Each grid 106 has a width of approximately one triad. A voltage of approximately 200 volts with respect to grids 100 is successively applied to adjacent grids 106 to cause the panel to be scanned column-wise. At television rates, each grid 106 is energized for approximately 125 nanoseconds.

Following grids 106 is a third dielectric spacer 108. Spacer 108 has a thickness of approximately 20 mils an an array of apertures 110, each of which is approximately as wide as ⅓ of a triad. Each triad of apertures 110 is aligned with a grid 106. See FIG. 5A for a more detailed view of spacer 108 and apertures 110.

Spacer 108 is followed by an array of electron-transmissive modulation grids 112 which extend column-wise for the entire height of the panel. Each grid 112R receives a red video signal and is in alignment with one column of apertures 110 in spacer 108. FIG. 5A and dashed lines 111 show the alignment of grids 112 with apertures 110. All grids 112R which receive a red video signal are electrically connected together. (The connection is now shown.) Grids 112B and 112G are similarly aligned and connected.

Another dielectric spacer 114 is adjacent to grids 112 and has an array of apertures 116 which are identical to and aligned with apertures 110 in spacer 108. Spacer 114 is approximately 120 mils thick.

Following spacer 114 is a glass faceplate 118 whose inner surface has deposited thereon triads of red, blue and green phosphor deposits (not shown), each of which is aligned with an aperture 116 in spacer 114.

For some applications, the embodiment depicted in FIG. 5 may be unnecessarily complex in that each cathode segment is driven separately. For example, in an application requiring 100 cathode segments of the type shown in FIG. 4, up to 100 discrete cathode drivers may be required to cause the discharge to move row-wise across the panel. However, as is well known in the art, each cathode segment need not necessarily have its own driver. Instead, perhaps every 20th or 30th cathode segment could be tied together and driven by a common driver. In the case where every 30th cathode segment is tied together, a 30-phase driver is required to move the discharge across the panel. Naturally, the fewer phases which can be used in a given application the less complex and less expensive the driving circuitry will be.

One factor which is most important in determining the number of phases required for driving the cathode segments is the de-ionization time of a single cathode segment. By de-ionization time is meant the time required for the plasma of a gas discharge to dissipate in a cathode segment. The faster the de-ionization time, the fewer the number of phases required to drive the cathode segments.

Figure 6:
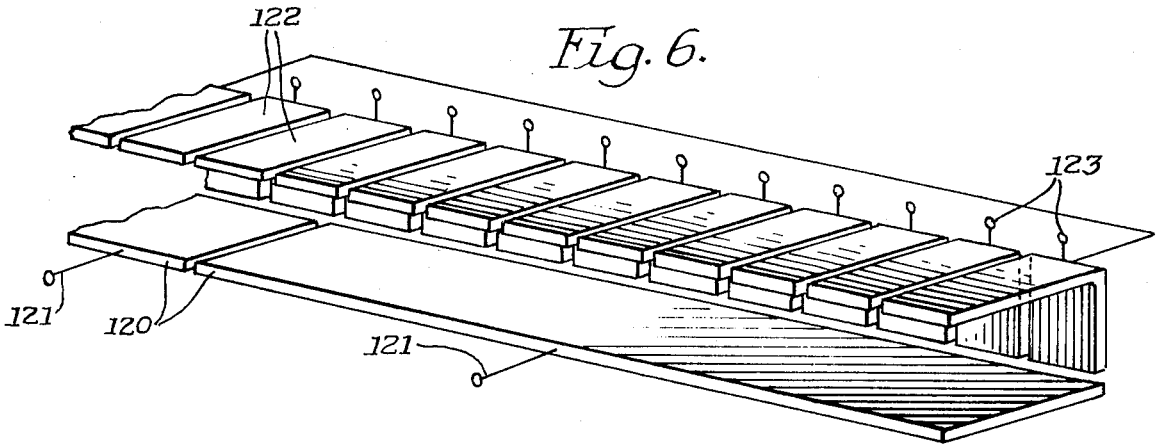
FIG. 6 illustrates schematically a cathode structure for use in certain gas discharge panels constructed according to this invention.

A novel cathode structure which has the ability to generate a gas discharge which is rich in electrons and which reduces the number of phases of drivers required to move the gas discharge across the panel is shown in FIG. 6. The cathode structure shown is for only a portion of one row of hollow cathodes but it may, of course, be extended to cover any number of rows. This hollow cathode structure has been split into two sections, an upper section and a lower section. The lower section includes at least one lower cathode plate 120 extending row-wise in the panel and adapted to receive a scanning potential at terminal 121.

Above each lower cathode plate 120 is a plurality of smaller cathode plates 122 which are situated substantially adjacent to each other in a row-wise plane above and parallel to lower cathode plate 120. Upper cathode plates 122 are adapted to sequentially receive the scanning potential at terminals 123 to excite a hollow cathode discharge in the volume partially enclosed by the lower cathode plate 120 and the upper smaller energized plate 122. This discharge is also initiated by use of an ignitor wire (not shown) which is positioned between plates 120 and 122.

As the upper cathode plates 122 sequentially receive the scanning potential, the hollow cathode discharge propagates across the panel. When the discharge reaches the end of a lower plate 120, the next adjacent lower plate and its first smaller upper cathode plate are energized to continue the propagation of the discharge across the panel.

With the arrangement shown in FIG. 6, the width of each lower cathode plate 120 may be stated generally as being equal to the width of M triads, where M may be equal to 10, for example. Each upper cathode plate 122 is preferably one triad wide. Thus, in general, for a panel having an array of X phosphor triads per row on its faceplate, there will be X/M lower plates per row and each lower plate 120 will be associated with M smaller upper cathode plates 122. When M equals 10, every tenth lower plate 120 will be electrically connected and every tenth upper plate 122 will be electrically connected so that horizontal scan can be accomplished with only 20 drivers, 10 for upper plates 122 and 10 for lower plates 120. Even with only 20 drivers, active cathode segments are separated by a distance of one hundred triads so that there is no problem with long de-ionization times.

In using the hollow cathode structure depicted in FIG. 6, one must be careful to choose the proper gas pressure. As the gas pressure is increased in a panel using the cathode structure of FIG. 6, application of an energizing potential to a lower cathode plate 120 or to an upper plate 122 may generate a premature discharge. This creation of a premature discharge may occur by virtue of the fact that, at the gas pressure involved, a lower plate 120 or an upper plate 122 is acting as a planar cathode. Therefore, care must be taken to insure that the pressure of the gas is at least below the point where an individual plate begins to act as a planar cathode.

Figure 7:
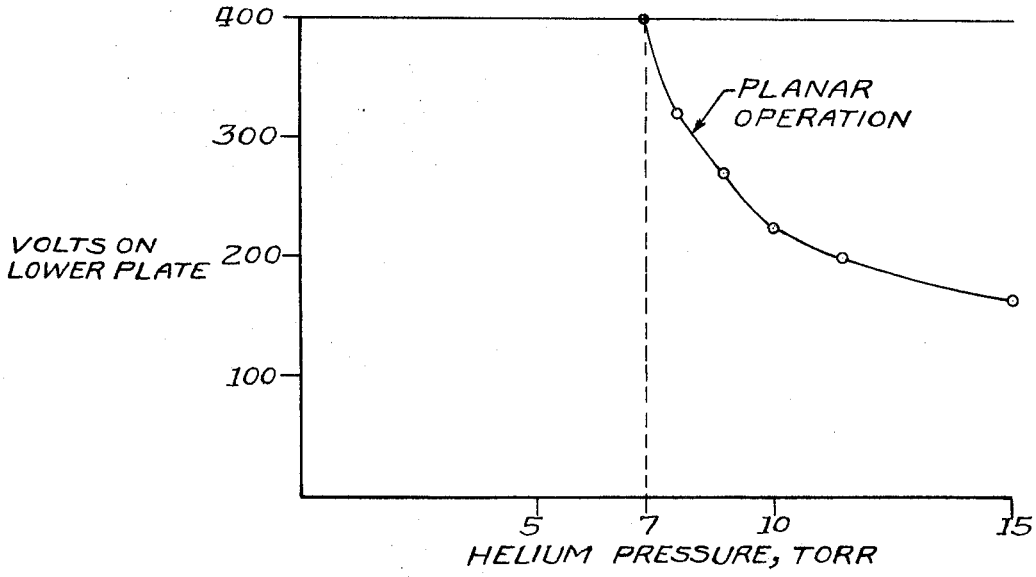
FIG. 7 and 8 are curves helpful in explaining the preferred operation of gas discharge structures according to this invention.

In order to determine the ideal gas pressure to be used in a given panel, energizing potentials can be applied to lower cathode plate 120 as the gas pressure is varied. Such an experiment was conducted on the embodiment shown in FIG. 6 wherein the spacing between the upper smaller cathode plates 122 and lower cathode plates 120 was 80 mils, approximately the height of two picture element rows in a 35 inch diagonal display. The results of that experiment are shown in FIG. 7 which is a plot of the voltage applied to lower plate 120 versus the pressure of helium in Torr. As shown in FIG. 7, for that particular embodiment, the pressure of helium must be maintained somewhere below 7 Torr to prevent lower cathode plate 120 from operating as a planar cathode.

Figure 8:
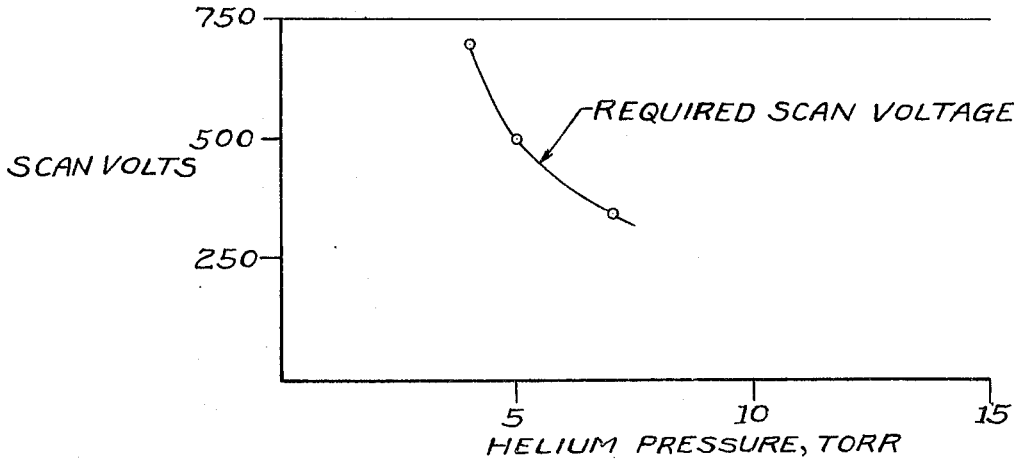

The pressure at which the FIG. 6 cathode structure is operated also determines the value of the potential which must be applied to the cathode plates to cause the hollow cathode discharge to propagate. The cathode structure which was used to generate the curve shown in FIG. 7 was also used to generate the curve shown in FIG. 8 which is a plot of applied scan voltage (energizing potential) versus helium pressure in Torr. As FIG. 8 shows, the value of the required scan voltage decreases as the gas pressure is increased. Combining the results of FIGS. 7 and 8 points to the conclusion that the cathode structure tested shold be operated just undr 7 Torr for maximum efficiency. In general, it can be stated that, for maximum efficiency, similar structures should be operated just below the pressure at which any of the cathode plates act as planar cathodes.

The cathode structure depicted in FIG. 6 may be substituted for the cathode structures depicted in FIGS. 4 and 5. The remaining elements to be used with the FIG. 6 cathode may be the same as those shown in either FIG. 4 or FIG. 5.

Another embodiment of this invention which reduces the number of phases of scan drivers is shown in FIG. 9. The structure shown therein embodies a combination of anode scan and cathode scan to reduce the number of required drivers and to simplify panel construction. It also has an additional anode which serves to assist in reducing the size of the electron beam spot as seen by a viewer.

Referring now to FIG. 9, there is shown an anode scan-cathode scan structure which operates in an environment of 4 Torr of helium. The cathode structure includes pairs of upper cathode plates 126 and lower cathode plates 128, upper cathode plates 126 being spaced from lower cathode plates 128 by a distance approximately equal to one row of picture elements and being in a plane substnatially parallel to lower cathode plates 128. The upper and lower cathode plates are each approximately 60 mils deep with each cathode plate extending horizontally across the panel for a distance approximately equal to 10 triads.

A discharge as initiated in each row of the FIG. 9 hollow cathodes by the use of an ignitor wire (not shown in this drawing) which starts a gas discharge between itself and cathode plates 126, 128 which are coupled to a source of −300 volts through a switch 129. Wires 130 which extend row-wise across the panel between each upper and lower cathode plate 126, 128 are additional anodes which serve to keep the beam spot size small in a way to be described below.

Following the cathode structure is a dielectric spacer 132 having an array of apertures 134. Spacer 132 is approximately 5 mils thick and each aperture 134 has a width of approximately one triad and a height of approximately one picture element.

Following spacer 132 is an array of electron-transmissive grids 136. Each grid 136 is approximately one triad wide and extends column-wise for substantially the entire height of the panel. Grids 136, in combination with cathode plates 126 and 128 perform the column-wise and row-wise selection of picture elements as follows. To scan the panel column-by-column an energizing potential of +100 volts is stepped from one grid 136 to the next adjacent grid. As every 10th grid 136 is activated, the next successive set of cathode plates 126, 128 are energized through a switch (or driver) 129. To scan the panel row-wise from top to bottom, an energizing potential of 1500 volts is stepped from one ignitor wire to the ignitor wire in the next row of hollow cathodes. Every 10th cathode segment is tied together (one cathode segmennt being one upper and one lower plate, 126, 128, covering 10 triads). Every 10th grid 136 is also electrically connected so that, to perform column-wise and row-wise selection of picture elements, only 20 phases of drivers are required.

Following grids 136 are four more elements which are the same as the corresponding four elements of FIG. 4. More specifically, following grids 136 is a dielectric spacer 137 indentical to spacer 76 of FIG. 4. Following spacer 137 is an array of electron-transmissive grids 138 which are identical to grids 80R, 80G and 80B of FIG. 4. As in the FIG. 4 structure, grids 138 receive red, blue and green video signals for modulating the electron beams and grids receiving the same "color" signal are electrically connected.

The array of grids 138 is followed by another dielectric spacer 139 identical to spacer 82 of FIG. 4 and with an identical array of apertures. Finally, the faceplate 140 of the FIG. 9 structure is identical to faceplate 86 of FIG. 4.

As has been pointed out above, an additional electrode 130 has been added to the structure of FIG. 9. The function of that electrode will now be explained.

It was discovered that the spot of light generated by some point-at-a-time embodiments was not as small and sharp as might be desired. This spot "smearing" was particularly noticeable on the trailing edge of the spot. This effect was found to be caused by the grid structure nearest the cathodes continuing to draw electrons from a residual plasma until the plasma dissipated itself by diffusion to the walls of the cathodes. By placing a potential of +90 volts on wire 130, any electrons remaining in an area supposedly "turned off" are drawn to wire 130 rather than forward where they can be accelerated toward the phosphors and contribute to a smearing of the electron spot. Whenever a grid 136 now receives an energizing potential, it becomes the active anode rather than wire 130 and draws current from the hollow cathode. The last energized grid 136 is then returned to ground and the next successive grid 136 or wire 130 draws electrons from the dissipating discharge which is present at the last active hollow cathode area corresponding to the last active picture element. Thus, electron flow to each grid 136 is prevented except when it is energized.

The embodiment shown in FIG. 9 exhibits a sharp reduction in the required scan voltages and thereby reduces the scanning reactive and resistive power to less than 50 watts for a 35 inch panel.

The concept of combining anode scan with cathode scan in the same structure also finds use in embodiments wherein the cathode plates are spaced apart by more than one row of picture elements. FIG. 10 illustrates such an embodiment which operates at 0.8 Torr of helium. At the rear of the FIG. 10 embodiment is a cathode structure comprising upper and lower cathode plates 141 and 142 which are spaced apart by 5 rows of picture elements. Plates 141 and 142 extend row-wise for 10 triads but may be lengthened to include more triads, such as 20, for example. Each plate 141 and 142 is approximately 300 mils deep. Situated between the cathode plates are rear anode wires 143 which serve the same purpose as wires 130 in FIG. 9.

Forward of the cathode structure is a dielectric spacer 144 having an array of apertures 146 which are 10 triads wide and 5 rows of picture elements high. Spacer 144 is approximately 20 mils thick.

Following spacer 144 is an array of electron-transmissive grids 148 extending column-wise for substantiaally the entire height of the panel. Each grid 148 is approximately 1 triad wide. Column selection of picture elements is effected by applying to successive grids 148 a potential of approximately +100 volts with respect to ground.

Following grids 148 is a dielectric spacer 150 which is 20 mils thick. Spacer 150 has an array of apertures 152 which are each approximately 1 picture element row high and one triad wide.

Spacer 150 is followed by another array of electron-transmissive grids 154 which extend row-wise substantially across the width of the panel. Each grid 154 is approximately one picture element high and receives an energizing potential of +200 volts with respect to grids 148. The +200 volt potential is stepped to successive grids for the row-wise selection of picture elements.

Following grids 154 and shown only very schematically is another dielectric spacer 156, an array of video modulating grids 158, another dielectric spacer 160 and a phosphor coated faceplate 162, all identical to corresponding elements 108, 112, 114 and 118 of FIG. 5.

A matter of interest which is an aspect of another invention, but which is nevertheless desirable to incorporate into some of the embodiments described above relates to the spacing between the cathodes and the first set of electron-transmissive grids or between successive arrays of grids. For example, referring to FIG. 2 it has been found that if the spacing between cathode plates 33, 34 and grids 38 is increased to one inch, the amplitude of the video modulating signals which are applied to grids 41 may be substantially decreased while at the same time increasing the available contrast ratio of the display panel. The reasoning behind this effect is disclosed in copending application Ser. No. 591,192 filed July 27, 1975. Briefly, it was believed that video modulating signals of approximately 200 volts were required to give an adequate contrast ratio for a panel built according to this invention. Signals of that amplitude were deemed necessary because of the great range of energies associated with the electrons which pass through grids 16. The greater the range of electron energy, the greater the amplitude of the video signals which are required to turn off or turn on the panel. By increasing the spacing between the cathode plates and the first grid assembly to a distance which is approximately one ionization mean free path, the electrons available at the first grid assembly are of a lower energy and of a much reduced energy range. Consequently, the control grids are able to control the electron stream which arrives at the faceplate with a much smaller video modulating signal. Thus, referring to FIG. 2, if spacer 36 is increased to one inch thick, the video modulating signals may be reduced in amplitude to 40 volts and yet increase the contrast ratio from 100 to 250.

Although this discovery of increasing the spacing between the cathode and the first grid assembly is known to decrease the required amplitude of the video signals, it is not yet clear what effect such an increase in that spacing will have on the ability of a panel to scan in a point-at-a-time mode. However, this discovery appears to be at least useful with line-at-a-time operated gas discharge panels and should be a great help in increasing the efficiency and commercial feasibility of such panels.

The invention described above and the various embodiments which are illustrated in the Figures are considered to be substantial advancements in the art of flat panel gas discharge displays. Panels constructed according to this invention are felt to exhibit the improvement in brightness which has been needed for the commercial introduction of gas discharge panels capable of producing quality television and alpha-numeric graphic images.

While this invention has been described in conjunction with several embodiments, both for point-at-a-time and for line-at-a-time image reproduction, many alterations and variations thereto will be apparent to those skilled in the art. Accordingly, it is intended to embrace all such alterations and variations which fall within the spirit and scope of this invention as defined by the appended claims.

We claim:

1. For use in a low pressure gas discharge panel for displaying images constituted of at least one row of picture elements, said panel having a rear section within which gas discharges are generated for use as sources of electrons with which to bombard and excite light-emitting phosphor targets near a front section of the panel, the combination comprising:

row-wise extending hollow cathode means located in the rear section of the panel and including at least one upper metal cathode plate and at least one lower metal cathode plate, each upper plate spaced from and extending substantially parallel to a lower plate so that together they partially enclose a volume within which a hollow cathode discharge can be established, the spacing between said upper and lower plates being between 0.1 and 3.0 times the length of the cathode fall of a planar cathode of the same metal operating in an atmosphere of the same gas and at the same pressure, said plates extending toward the front of the panel a distance which is at least as great as the spacing between the plates and having a width at least as great as the spacing between the plates;

first electron-transmissive grid means situated forward of said hollow cathode means and adapted to receive a first energizing potential for extracting electrons from a hollow cathode discharge established within the volume partially enclosed by said cathode plates;

second electron-transmissive grid means situated forward of said first grid means and adapted to receive a second energizing potential for controlling the flow of electrons through said first and second grid means;

a faceplate in the front section of the panel having a phosphor coating thereon which emits light when struck by electrons, said faceplate adapted to receive a third energizing potential for accelerating toward the phosphor coating those electrons which pass through said second grid means, the faceplate and the second grid means being spaced apart by a distance which is too small to sustain a gas discharge at the gas pressure which exists in the panel.

2. The combination as set forth in claim 1 further including means for causing the hollow cathode discharge to scan point-at-a-time row-wise across the panel.

3. The combination as set forth in claim 1 wherein said panel is scanned in point-at-a-time mode and including an electrode situated within the volume partially enclosed by said cathode plates and adapted to receive an energizing potential for drawing electrons to itself from any residual plasma remaining in a "turned off" hollow cathode area so as to prohibit said electrons from being extracted and exciting the phosphor coating in an area of the faceplate which would create an impression of spot smearing.

4. A combination as set forth in claim 1 for scanning successive rows of picture elements wherein said hollow cathode means includes rows of upper and lower cathode plates separated by a distance approximately equal to one row of picture elements and wherein said combination includes means for moving the discharge from one row of cathode plates to the next adjacent row of cathode plates to effect row-wise scanning of the panel.

5. The combination as set forth in claim 4 wherein said faceplate has triads of red, blue and green phosphor deposits and wherein said second electron-transmissive grid means includes an array of column-wise extending modulation grids, each modulation grid being approximately as wide as and aligned with one phosphor deposit, and each adapted to receive a video signal for modulating the flow of electrons through itself.

6. The combination as set forth in claim 5 for use in a gas discharge panel which is scanned point-at-a-time wherein said first electron-transmissive grid means includes an array of column-wise extending grids which are each approximately one triad wide and which are adapted to sequentially receive an energizing potential for effecting column-by-column scanning of the panel.

7. The combination as set forth in claim 5 for use in a gas discharge panel operated in a point-at-a-time mode wherein said hollow cathode means includes rows of sequentially energizeable hollow cathodes, each hollow cathode in a row of sequentially energizeable hollow cathodes having an upper plate and an associated lower plate constituting a pair of plates between which a hollow cathode discharge is established, and each pair of plates being approximately one triad wide and adapted to sequentially receive an energizing potential for sequentially exciting the hollow cathode discharge and propagating it across the panel.

8. The combination as set forth in claim 1 for use in a gas discharge panel operated in a line-at-a-time mode wherein said first electron-transmissive grid means includes an array of row-wise extending grids adapted to sequentially receive an energizing potential for effecting row by row scanning of the panel, each grid being approximately one picture element row high, and wherein said second electron-transmissive grid means includes an array of column-wise extending modulation grids, each modulation grid being approximately as wide as and aligned with one phosphor deposit and each adapted to receive a video signal for modulating the flow of electrons through itself.

9. The combination as set forth in claim 8 wherein each upper and lower cathode plate extends row-wise for approximately the entire width of the panel and wherein the distance between upper and lower cathode plates is greater than the height of one row of picture elements.

10. The combination as set forth in claim 1 for use in a gas discharge panel operated in a point-at-a-time mode wherein said panel includes rows of hollow cathodes and said hollow cathode means includes, in each row of hollow cathodes, successive cathode segments, each segment including an upper cathode plate and an associated lower cathode plate, each segment having a width which is greater than the width of one triad and adapted to sequentially receive an energizing potential for propagating the hollow cathode discharge row-wise across the panel.

11. The combination as set forth in claim 10 wherein said first electron-transmissive grid means includes an array of column-wise extending grids adapted to sequentially receive an energizing potential for effecting column-wise scanning of the panel, each such grid being approximately one triad wide.

12. The combination as set forth in claim 11 wherein said upper and lower cathode plates are separated by a distance approximately equal to one picture element row and wherein said combination includes means for effecting row by row scanning of the panel by transferring the discharge from one row of hollow cathodes to the next adjacent row of hollow cathodes.

13. The combination as set forth in claim 11 wherein said upper and lower cathode plates are separated by a distance greater than one picture element row, wherein said second electron-transmissive grid means includes an array of row-wise extending scan grids adapted to sequentially receive an energizing potential for effecting row-wise scanning of the panel, and wherein said combination includes an array of column-wise extending modulation grids situated between said scan grids and said faceplate, each modulation grid being approximately as wide as and aligned with one phosphor deposit, and each being adapted to receive a video signal for modulating the flow of electrons through itself.

14. The combination as set forth in claim 1 for use in a gas discharge panel operated in a point-at-a-time mode wherein said hollow cathode means includes at least one lower cathode plate extending row-wise in the panel and adapted to receive a scanning potential, and a plurality of smaller cathode plates situated substantially adjacent to each other in a row-wise plane above and substantially parallel to said lower cathode plate, each of said smaller cathode plates adapted to sequentially receive scanning potential for exciting a hollow cathode discharge in the volume partially enclosed by the lower cathode plate and the upper smaller energized plate, which discharge propagates along the row as each smaller cathode plate successively receives sad scanning potential.

15. The combination as set forth in claim 14 wherein the phosphor coating on said target anode comprises triads of red, blue and green light-emitting phosphor strips and wherein said lower cathode plates are each approximately M triads wide and, above each lower cthode plate, M smaller cathode plates, each approximately 1 triad wide.

16. For use in a low pressure gas discharge panel for displaying images constituted of rows of picture elements, said panel having a rear section within which gas discharges are generated for use as sources of electrons with which to bombard and excite light-emitting phosphor targets near a front section of the panel, the combination comprising:

pairs of row-wise extending upper and lower cathode plates located in the rear section of the panel, each upper plate spaced from and extending substantially parallel to a lower plate so that together they partially enclose a volume within which a hollow cathode discharge can be estabished, the spacing between said upper and lower plates being approximately equal to one row of picture elements, and said plates extending toward the front of the panel a distance which is at least as great as the spacing between them;

first electron-transmissive grid means situated forward of said hollow cathode means and adapted to receive an energizing potential for extracting electrons from a hollow cathode discharge established within the volume partially enclosed by a pair of cathode plates;

an array of column-wise extending electron-transmissive modulation grids situated forward of said first grid means and adapted to receive video signals for modulating the flow of electrons through themselves;

a faceplate in the front section of the panel having a phosphor coating thereon which includes triads of red, blue and green phosphor deposits, said faceplate adapted to receive an energizing potential for accelerating toward the phosphor coating those electrons which pass through said second modulation grids, the spacing between the first grid means and the modulation grids and the spacing between the modulation grids and the faceplate being both too small to sustain a gas discharge therebetween at the gas pressure which exists in the panel.

17. For use in a low pressure gas discharge panel for displaying images constituted of rows of picture elements, said panel having a rear section within which gas discharges are generated for use as sources of electrons with which to bombard and excite light-emitting phosphor targets near a front section of the panel in a line-at-a-time mode, the combination comprising:

row-wise extending hollow cathode means located in the rear section of the panel and including at least one upper metal cathode plate and at least one lower metal cathode plate, each upper plate spaced from and extending substantially parallel to a lower plate so that together they partially enclose a volume within which a hollow cathode discharge can be established, the spacing between said upper and lower plates being between 0.1 and 3.0 times the length of the cathode fall of a planar cathode of the same metal operating in an atmosphere of the same gas and at the same pressure, said plates extending toward the front of the panel a distance which is at least as great as the spacing between the plates and having a width at least as great as the spacing between the plates;

an array of row-wise extending, electron-transmissive scan grids situated forward of said hollow cathode means, said scan grids being each approximately one picture element row high and adapted to sequentially receive an energizing potential for the row-by-row extraction of electrons from a hollow cathode discharge established within the volume partially enclosed by said cathode plates;

an array of column-wise extending, electron-transmissive modulation grids situated forward of said scan grids and adapted to receive an electrical signal for modulating the flow of electrons through themselves;

a faceplate in the front section of the panel having a phosphor coating thereon which emits light when struck by electrons, said faceplate adapted to receive an energizing potential for accelerating toward the phosphor coating those electrons which pass through said modulation grids, the faceplate and the modulation grids being spaced apart by a distance which is too small to sustain a gas discharge therebetween at the gas pressure which exists in the panel.

18. For use in a low pressure gas discharge panel for displaying images constituted of rows of picture elements and within the rear of which panel gas discharges are generated for use as sources of electrons with which to bombard and excite light-emitting phosphor targets near the front of the panel in a point-at-a-time mode, the combination comprising:

pairs of upper and lower cathode plates located in the rear section of the panel and extending row-wise for substantially the entire width of the panel, each upper plate spaced from and extending substantially parallel to a lower plate so that together they partially enclose a volume within which a hollow cathode discharge can be established, the spacing between said upper and lower plates being greater than one row of picture elements, and said plates extending toward the front of the panel a distance which is at least as great as the spacing between them;

an array of column-wise extending, electron-transmissive scan grids situated forward of said hollow cathode means and adapted to sequentially receive an energizing potential for extracting electrons in a column-by-column manner from a hollow cathode discharge established within the volume partially enclosed by a pair of cathode plates;

an array of row-wise extending, electron-transmissive scan grids situated forward of said column-wise extending scan grids and adapted to sequentially receive an energizing potential for effecting row-by-row scanning of the panel;

an array of column-wise extending, electron-transmissive modulation grids situated forward of said row-wise extending scan grids and adapted to receive electrical signals for modulating the flow of electrons through themselves;

a faceplate near the front of the panel having a phosphor coating thereon which includes triads of red, blue and green phosphor deposits, said faceplate adapted to receive an energizing potential for accelerating toward the phosphor coating those electrons which pass through said modulation grids, the spacing between arrays of grids and the spacing between the modulation grids and the faceplate being too small to sustain a gas discharge therebetween at the gas pressure which exists in the panel.

19. For use in a low pressure gas discharge panel for displaying images constituted of rows of picture elements and within the rear of which panel gas discharges are generated for use as sources of electrons with which to bombard and excite triads of light-emitting phosphor targets near the front of the panel, the combination comprising:

row-wise extending hollow cathode means located in the rear section of the panel including rows of hollow cathode segments, each such segment including an upper metal cathode plate and an associated lower metal cathode plate separated by a distance approximately equal to one picture element row, each upper plate spaced from and extending substantially parallel to its associated lower plate so that together they partially enclose a volume within which a hollow cathode discharge can be established, all hollow cathode segments having a width which is greater than the width of a phosphor triad and all segments in any row being adapted to sequentially receive an energizing potential for propagating the hollow cathode discharge row-wise across the panel;

an array of column-wise extending, electron-transmissive scan grids situated forward of said hollow cathode means and adapted to sequentially receive an energizing potential for the column-by-column extraction of electrons from a hollow cathode discharge established within a volume partially enclosed by said cathode plates;

an array of column-wise extending, electron-transmissive modulation grids situated forward of said scan grids and adapted to receive a video signal for modulating the flow of electrons through themselves;

a faceplate in the front section of the panel having thereon triads of phosphor deposits which emit light when struck by electrons, said faceplate adapted to receive an energizing potential for accelerating toward the phosphor deposits those electrons which pass through said modulation grids, the spacing between arrays of grids and the spacing between the faceplate and the modulation grids being too small to sustain a gas discharge therebetween at the gas pressure which exists in the panel.

20. The combination as set forth in claim 19 wherein said panel is scanned in point-at-a-time mode and including an electrode situated within the volume partially enclosed by said cathode plates and adapted to receive an energizing potential for drawing electrons to itself from any residual plasma remaining in a "turned off" hollow cathode area so as to prohibit said electrons from being extracted and exciting the phosphor coating in an area of the faceplate which would create an impression of spot smearing.

21. For use in a low pressure gas discharge panel for displaying images constituted of rows of picture elements and within the rear of which panel gas discharges are generated for use as sources of electrons with which to bombard and excite triads of light-emitting phosphor targets near the front of the panel, the combination comprising:

row-wise extending hollow cathode means located in the rear section of the panel including rows of hollow cathode segments, each such segment including an upper metal cathode plate and an associated lower metal cathode plate spaced apart by a distance greater than one picture element row, each upper plate extending substantially parallel to its associated lower plate so that together they partially enclose a volume within which a hollow cathode discharge can be established, all hollow cathode segments having a width which is greater than the width of a phosphor triad and all segments in any row being adapted to sequentially receive an energizing potential for propagating the hollow cathode discharge row-wise across the panel;

an array of column-wise extending, electron-transmissive scan grids situated forward of said hollow cathode means and adapted to sequentially receive an energizing potential for the column-by-column extraction of electrons from a hollow cathode discharge established within a volume partially enclosed by said cathode plates;

an array of row-wise extending, electron-transmissive scan grids situated forward of said column-wise extending scan grids and adapted to sequentially receive an energizing potential for effecting row-wise scanning of the panel;

an array of column-wise extending, electron-transmissive modulation grids situated forward of said row-wise extending scan grids and adapted to receive video signals for modulating the flow of electrons through themselves;

a faceplate in the front section of the panel having thereon triads of phosphor deposits which emit light when struck by electrons, said faceplate adapted to receive an energizing potential for accelerating toward the phosphor deposits those electrons which pass through said modulation grids, the spacing between all arrays of grids and the spacing between the faceplate and the modulation grids being too small to sustain a gas discharge therebetween at the gas pressure which exists in the panel.

22. The combination as set forth in claim 21 wherein said panel is scanned in point-at-a-time mode and including a row-wise extending electrode situated within the volume partially enclosed by said cathode plates and adapted to receive an energizing potential for drawing electrons to itself from any residual plasma remaining in a turned off hollow cathode area so as to prohibit said electrons from being extracted and exciting the phosphor coating in an area of the faceplate which would create an impression of spot smearing.

23. For use in a gas discharge panel having rows and columns of gas discharge cells and having hollow cathodes for generating the gas discharges, an improved hollow cathode structure for scanning gas discharges along columns of cells, comprising:

at least one lower cathode plate extending row-wise in the panel and adapted to receive an energizing potential;

a plurality of smaller cathode plates situated substantially adjacent to each other in a row-wise plane above and substantially parallel to said lower cathode plate, each of said smaller cathode plates adapted to sequentially receive said energizing potential to excite a hollow cathode discharge in the volume partially enclosed by the lower cathode plate and the upper smaller energized plate, which discharge propagates along the row as each smaller cathode plate is successively energized; and an electrode situated within the volume partially enclosed by said cathode plates and adapted to receive a voltage for drawing electrons to itself from any residual plasma remaining in a turned off hollow cathode area.

24. An improved hollow cathode structure as set forth in claim 23 wherein said gas discharge panel is a point-at-a-time color display device within the rear of which gas discharges are generated for use as sources of electrons with which to bombard and illuminate triads of red, blue and green light-emitting phosphor strips near the front of the panel and wherein said hollow cathode structure includes a plurality of lower cathode plates each approximately M triads wide, and M smaller upper cathode plates, each approximately 1 triad wide, above each lower cathode plate.

25. A hollow cathode structure as set forth in claim 24 wherein said gas discharge panel includes X phosphor triads per row and X/M lower cathode plates per row, wherein each lower cathode plate and its associated smaller upper cathode plates constitute a scan segment, and wherein the first, second . . . Mth smaller plates of a segment are respectively electrically connected to the first, second . . . Mth smaller plates of every segment in a row for sequentially receiving an M phase scan potential.

* * * * *